US008322875B2

(12) United States Patent
Brinson

(10) Patent No.: US 8,322,875 B2
(45) Date of Patent: Dec. 4, 2012

(54) VESSEL MOUNTED LIGHT

(76) Inventor: Marlin Brinson, Miami, FL (US)

( * ) Notice: Subject to any disclaimer, the term of this patent is extended or adjusted under 35 U.S.C. 154(b) by 147 days.

(21) Appl. No.: 12/902,956

(22) Filed: Oct. 12, 2010

(65) Prior Publication Data

US 2011/0096532 A1 Apr. 28, 2011

Related U.S. Application Data

(60) Provisional application No. 61/279,829, filed on Oct. 26, 2009.

(51) Int. Cl.
*F21V 33/00* (2006.01)

(52) U.S. Cl. ..... 362/101; 362/154; 362/800; 362/806

(58) Field of Classification Search ..... 362/101, 362/800, 806, 154, 157, 249, 249.1, 249.11, 362/640, 645, 646; 40/324, 463
See application file for complete search history.

(56) References Cited

U.S. PATENT DOCUMENTS

| | | | | |
|---|---|---|---|---|
| 3,300,632 | A * | 1/1967 | Kinn | 362/136 |
| 4,055,014 | A * | 10/1977 | Schmidt et al. | 40/442 |
| 5,119,279 | A * | 6/1992 | Makowsky | 362/101 |
| 5,339,548 | A * | 8/1994 | Russell | 40/324 |
| 5,785,407 | A * | 7/1998 | Ratcliffe et al. | 362/101 |
| 6,005,204 | A * | 12/1999 | Choi et al. | 200/52 R |
| 2004/0004830 | A1 * | 1/2004 | Rudell et al. | 362/101 |

* cited by examiner

*Primary Examiner* — John A Ward
(74) *Attorney, Agent, or Firm* — Christopher J. Vandam, PA; Chris Vandam

(57) ABSTRACT

A novelty light device that provides a light assembly capable of adhesion to the bottom of a cup, vase or bottle connected to a switch-able power supply by a thin electrical conductor. The thin electrical conductor enhances the stability of the bottle by minimally interfering with the configuration of the bottom of the bottle. A power supply is also provided that may be adhered to the side of the bottle. Variations in the switching means allow the device to be turned on once only or repeatedly selectable to on and off.

9 Claims, 9 Drawing Sheets

VESSEL MOUNTED LIGHT

Applicant hereby claims priority benefit of earlier filed provisional application by the same inventor having Ser. No. 61/279,829 filed on Oct. 26, 2009, which is incorporated herein, in its entirety, by reference.

BACKGROUND OF THE INVENTION

1. Field of the Invention

The present invention relates to party novelty accessories, and more particularly, to a light system adapted for use with transparent glass or plastic, for example, a bottle, a cup, or a window.

2. Description of the Related Art

Several designs for lighted party novelties have been designed in the past. None of them, however, are known to include a switch, a power source and a light source that may be affixed to the bottom surface of a vessel, such as a bottle or cup, without affecting the usage or stability of that vessel and also producing a novel effect of illuminating the vessel using the vessel itself to disperse the light.

Other patents describing the closest subject matter provide for a number of more or less complicated features that fail to solve the problem in an efficient and economical way. None of these patents suggest the novel features of the present invention.

SUMMARY OF THE INVENTION

It is one of the main objects of the present invention to provide a device that illuminates a vessel, such as a bottle or cup.

It is another object of this invention to provide a device that does not affect the safety or stability of the vessel.

Another object of the invention is to provide a light emitting device remote from its power source.

It is still another object of the present invention to provide an eye-catching novel device that will not inadvertently detach from the vessel to which it is affixed.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
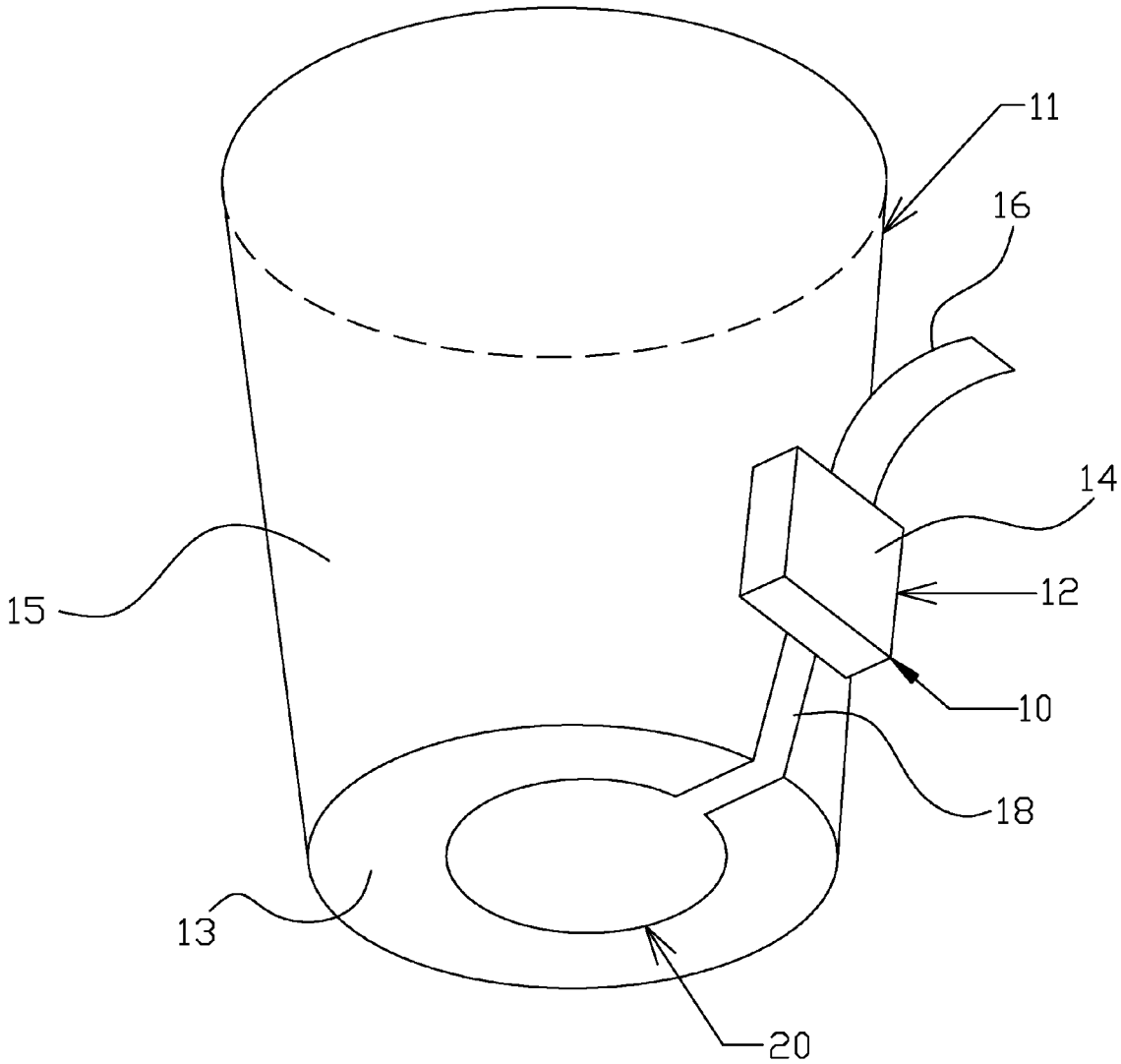
FIG. 1 represents a perspective view of a variation of the device attached to the underside of a common cup.

Referring now to the drawings, where the present invention is generally referred to with numeral 10, it can be observed that it basically includes a battery assembly 12 and a light assembly 20. The battery assembly 12 is further comprised of, inter alia, a case 14, a tab 16 and a conductor 18. A vessel 11 is also shown for context but is not present in every contemplated use of the device. Elements of the vessel 11 further comprise a planar foot 13 forming the bottom of the vessel 11 and a sidewall 15 forming the side of the vessel.

The vessel 11 shown in the variation of the invention depicted in FIG. 1 may be a common cup made of glass, plastic or other commonly available material. Preferably the vessel 11 is constructed of a transparent or translucent material at least on the bottom of the foot 13 which may contact a table when the vessel 11 is in normal use. Other parts of the vessel 11 can have opacity of varying degrees. The vessel 11 can effectively also be in the form of a vase, bottle, jug or other similar structure.

As demonstrated in FIG. 1 the light assembly 20 may be affixed to the outer surface of the foot 13. The light assembly 20 can selectively produce light and emit the light into and through the foot 13 thereby illuminating the contents of the vessel 11 and the vessel 11 itself producing a lighted effect.

In use, the battery assembly 12 is preferably affixed to a sidewall 15 of the vessel 11. The battery assembly 12 and the light assembly 20 are physically linked by the conductor 18. In a preferred variation of the device the conductor 18 may take the form of a thin ribbon wire or flexible electronics also known as flex circuits or thin film flexible circuit boards. Other thin and flexible means of conducting electric current could also readily be used.

In a primary version of the device 10, it is important that the conductor 18 is as thin as practicable. It is also important to have the light assembly 20 as thin as practicable. Since the light assembly 20, in some applications of the device, is placed between the vessel 11 and a table (or other supportive surface), the vessel 11 could become unstable if the light assembly 20 is not thin enough. The stability of the vessel 11 may be increased by any or all of: dimensioning the light assembly 20 similar to that of the foot 13, ensuring that the light assembly 20 has a uniform thickness and/or having the light assembly have as minimal a thickness as practicable, yet remaining effective in producing light and adhering to the foot 13.

Flexible electronics, generally, is a technology for assembling electronic circuits by mounting electronic devices on flexible thin plastic substrates. These substrates could be, for example, a polyimide and/or PEEK Film. Other methods could include screen printed metal alloy circuits on polyester substrate. Other low profile electronic conductors could also be effectively used to transmit power from the battery assembly 12 to the light assembly 20.

Alternatively, the conductor 18 could also be a fiber optic type conductor to conduct light produced at or near the battery assembly 12 to the light assembly 20 where the light is emitted into the foot 13 of the vessel 11. In this embodiment the light assembly 20 may also include a lens feature to aid in light disbursement.

Figure 2:
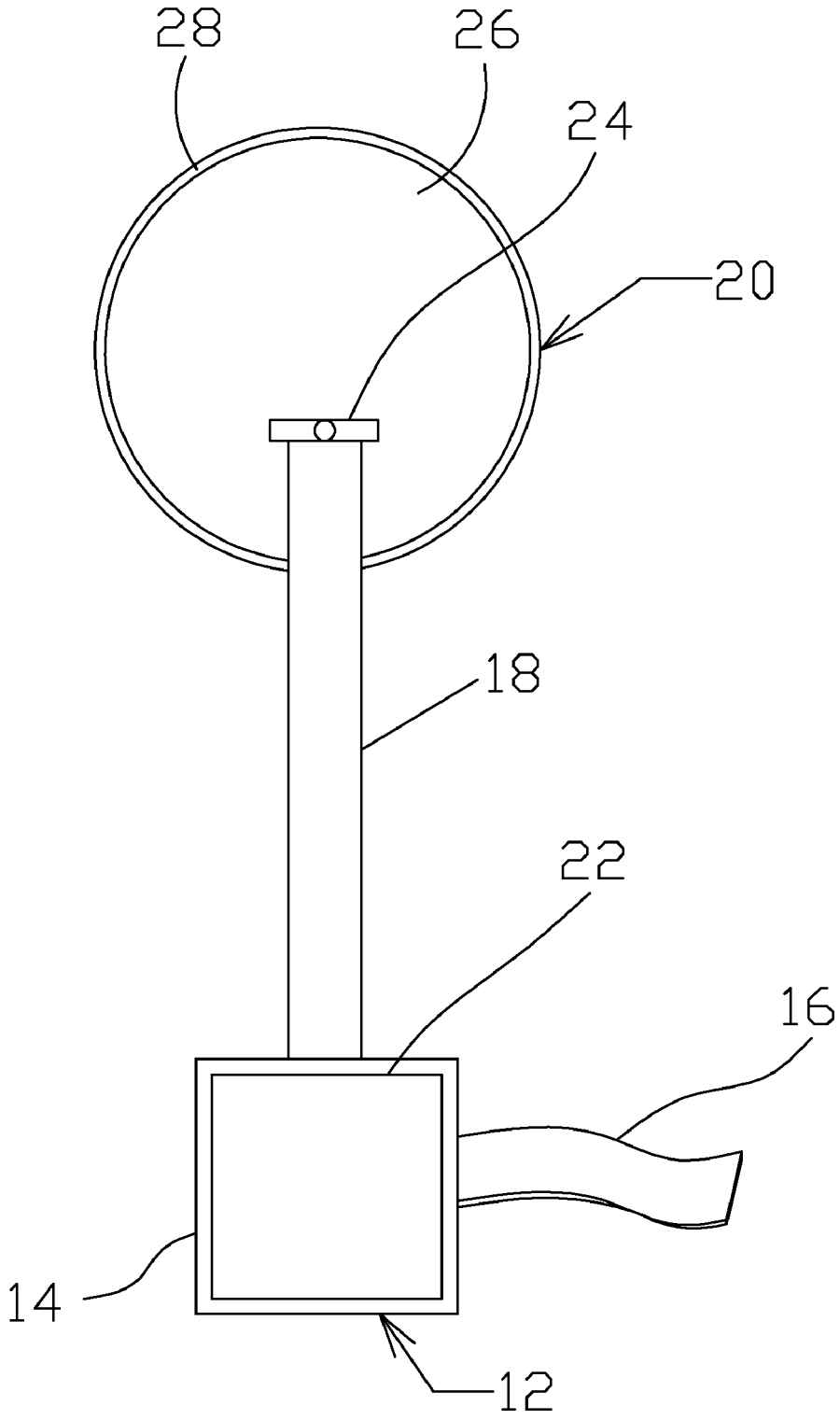
FIG. 2 shows a plan view of a version of the device.
Figure 3:
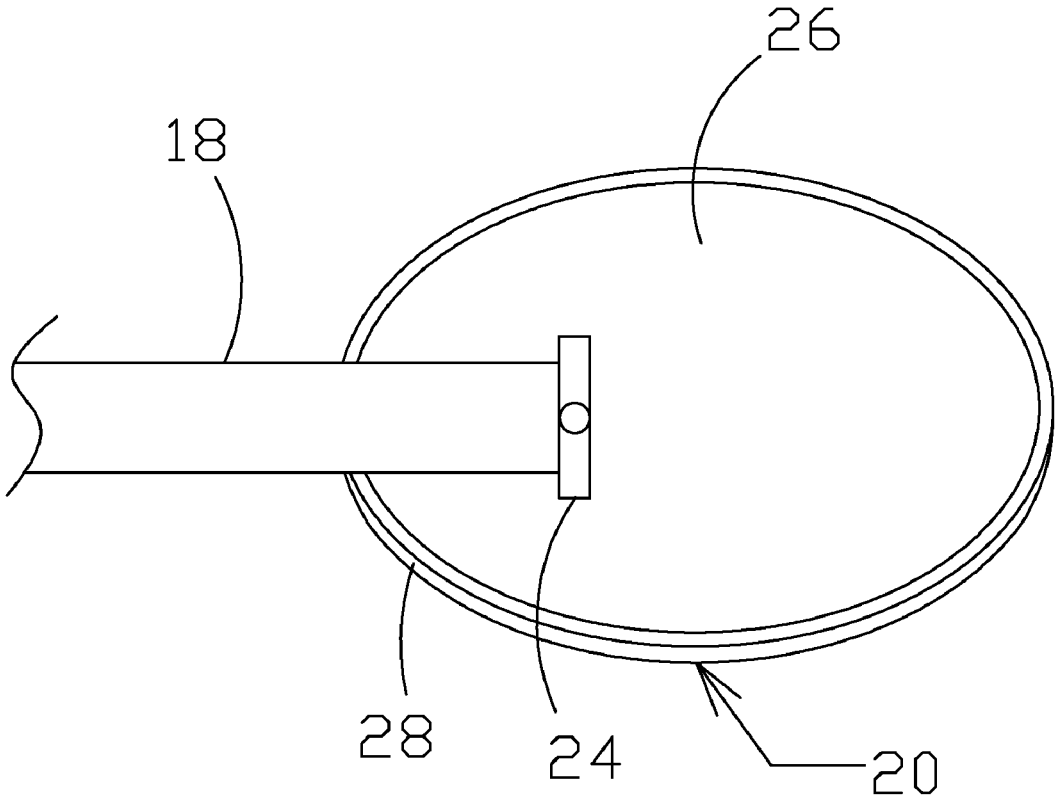
FIG. 3 illustrates a perspective view of a variant of a light assembly.
Figure 4:
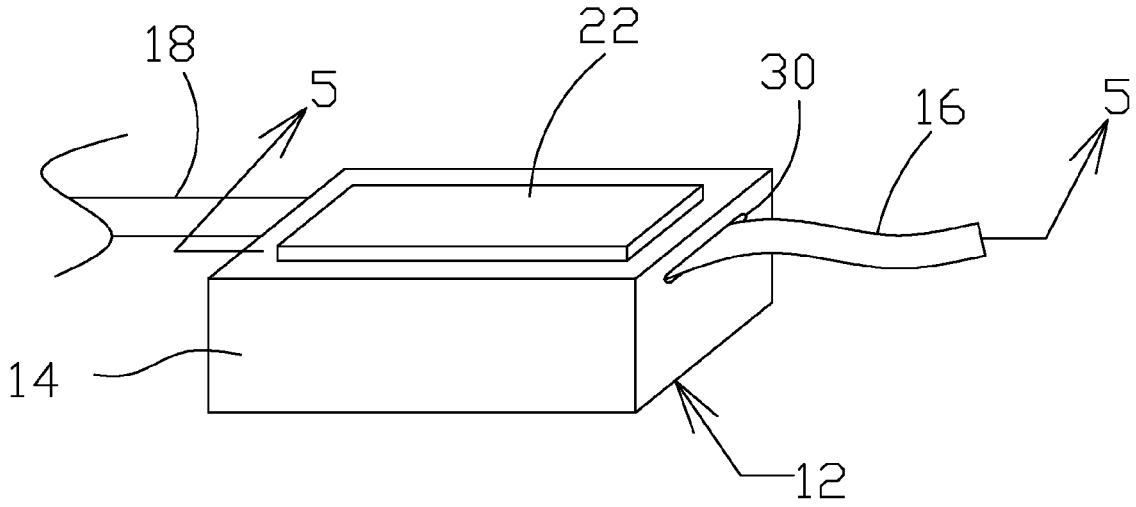
FIG. 4 is a representation of perspective view of version of a battery assembly.

Now referring to FIGS. 2, 3 and 4 where a device similar to that shown in FIG. 1 is shown in more detail and further includes, inter alia, a pad 22, a light 24, a backing 26, a substrate 28 and an aperture 30.

Looking at a variation of the light assembly 20 in more detail it can be seen that the backing 26 is affixed onto the substrate 28. Between the substrate 28 and the backing 26 is an adhesive means, such as a pressure sensitive adhesive. This adhesive is preferably water resistant. When preparing the device 10 for use the backing 26 is peeled away from the substrate 28 to expose the adhesive so that the light assembly 20 may be secured to a vessel, such as vessel 11 shown in FIG. 1, or other transparent or semi-transparent object.

The light 24 may be affixed to the substrate 28. Although not depicted in FIG. 3 there may optionally be a channel from the light 24 to the periphery of the pad where the conductor 18 may be positioned. This channel feature may aid in having a light assembly 20 of uniform thickness which can aid in stability of the vessel 11.

In a preferred variation of the light assembly 20 the substrate 28 has applied to it a pressure sensitive adhesive which is temporarily covered by the backing 26 for storage and transport. When the device is prepared for use by combining it with, for example, a glass bottle, the backing 26 is removed and discarded. This adhesive would then permit the light assembly 20 to be adhered to a surface such as onto the foot 13 of the vessel 11 as shown on FIG. 1 and described above.

The substrate 28 may provide a more robust structure and could also, for example, provide a reflective quality to aid in directing any luminescence away from the light 24 if made of a reflective material, such as for example, an aluminum film. Other reflective materials such a metalized polyethylene terephthalate (sometimes referred to as mylar) or other thin film alloys or polymer compositions may prove to be more or less effective. By directing the reflected light into the foot 13 of the vessel 11 the intensity of the perceived luminescence may be increased or a lower capacity battery may become suitable.

Now examining FIG. 4 where a variation of the battery assembly 12 it is shown in more detail to include a pad 22 that includes a means, such as a pressure sensitive adhesive, to affix the battery assembly 12 to another object, such as the sidewall 15 of a vessel 11. In a preferred variation the pad 22 is comprised of an adhesive and a release backing where the release backing is separable from the adhesive and is discarded immediately prior to use to expose the adhesive. Alternate means to affix the battery assembly 12 to an object are readily available and may include a bracket, sleeve, band, clip, non-pressure sensitive adhesive or other means.

By designing the battery assembly 12 to be remote from the light assembly 20 the battery assembly 12 may be located other than on the foot 13 of the vessel. Because the battery assembly 12 generally cannot be as flat as the light assembly 20 it is preferably not affixed to the foot 13 of the vessel 11. Instead, the thin conductor 18 supplies the power from the battery assembly 12 to the light assembly 20 from a remote location, such as the sidewall 15 of a glass or bottle.

The tab 16 functions as switch. The aperture 30 is provided on the battery assembly 12 to permit a path of egress for the tab 16. The tab 16 preferably is constructed of a material that does not conduct electricity, having a high electrical resistivity factor. A variety of thin film plastics and paper are effective materials and other materials have been contemplated.

Referring now to FIGS. 5, 6, 7, 8 and 9 where the battery assembly 12 is shown to further include a battery 32, a conductor 38, a conductor 40, a terminal 42 and a terminal 44. An alternate variation of a tab 34 is shown to include an aperture 36. The functionality of the several iterations of the tab 16 and tab 34 are shown to function as a switch.

Figure 5:
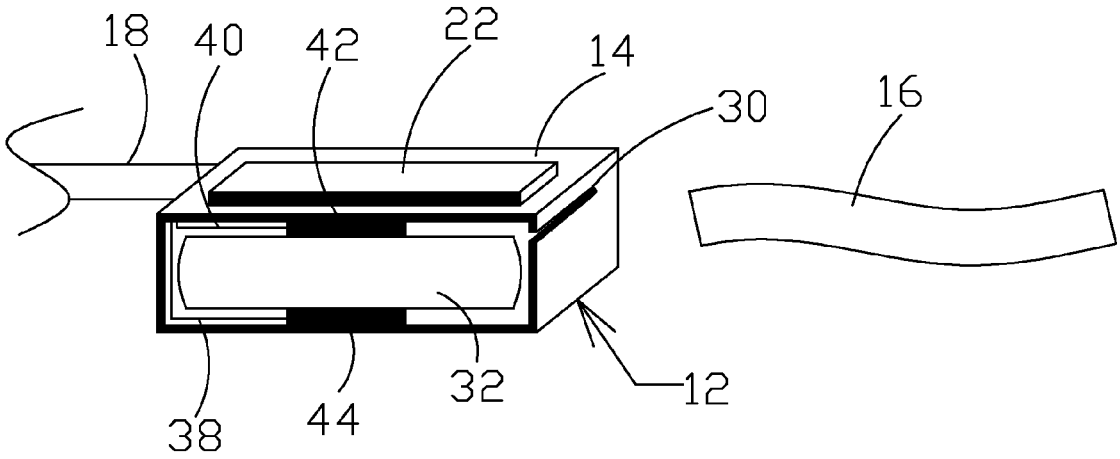
FIG. 5 is a depiction of a perspective cross section of a variant of a battery assembly.
Figure 6:
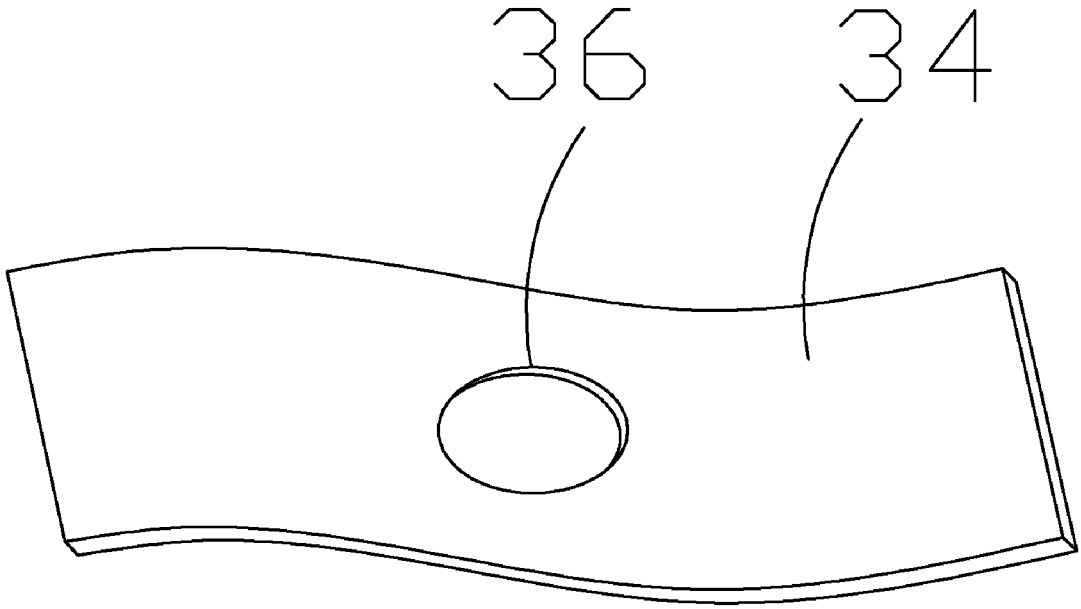
FIG. 6 is a perspective view of an alternate tab.
Figure 7:
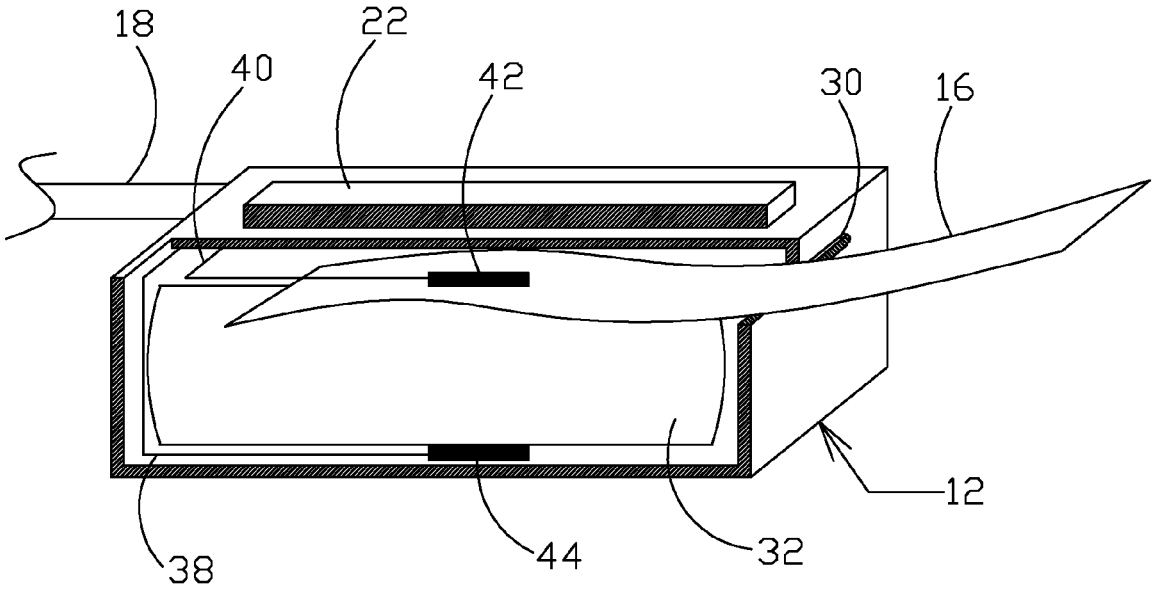
FIG. 7 shows a perspective cross section view of a battery assembly showing functionality of a tab.
Figure 8:
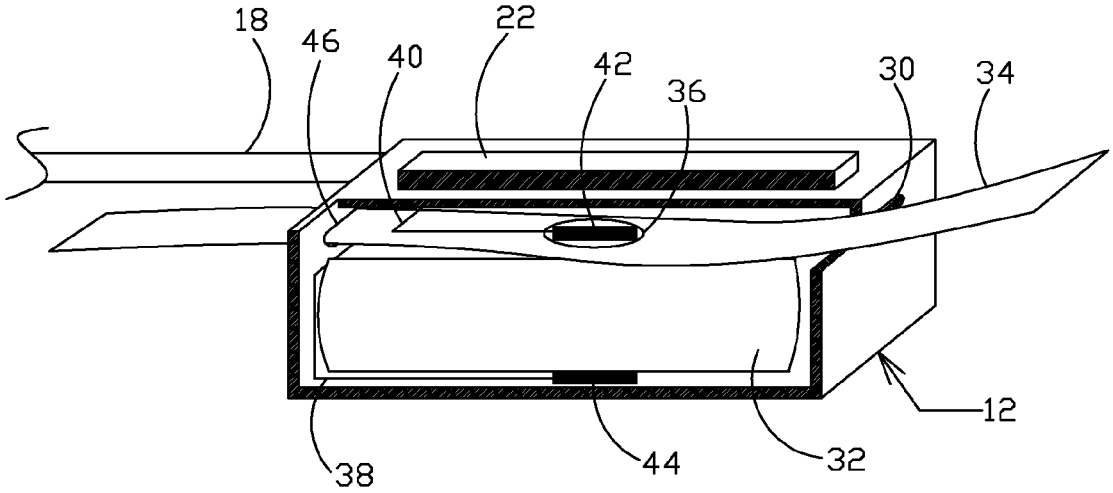
FIG. 8 illustrates a perspective cross section view of a battery assembly demonstrating an alternate tab position.
Figure 9:
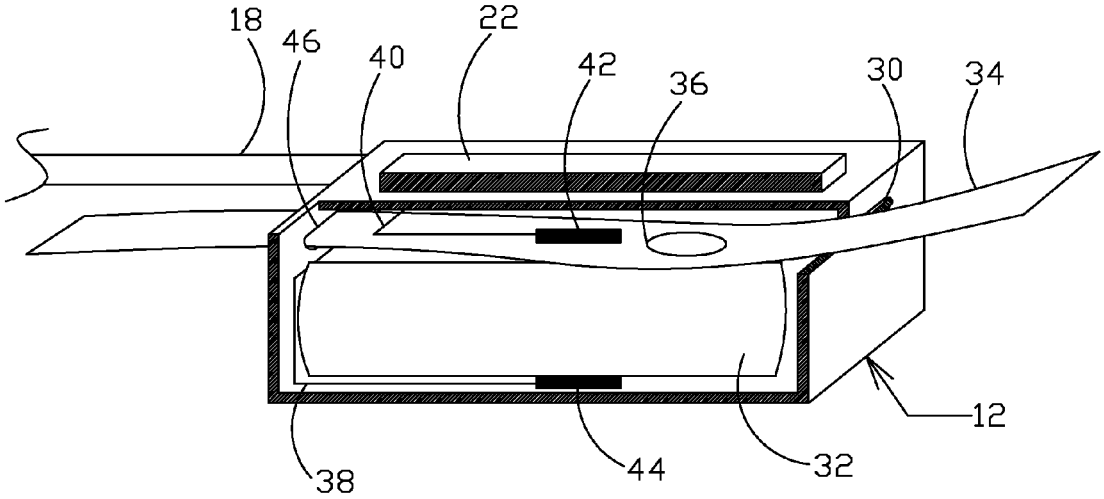
FIG. 9 is a perspective cross section view of a battery assembly similar to that shown in FIG. 9 demonstrating an alternate tab position.

Generally, FIGS. 5 and 7 show a single variation in different stages of operation. Generally, FIGS. 6, 8 and 9 show an alternate variation emphasizing the switching means and tab 34.

Note that the section plane is identified on FIG. 4 with the numeral 5 and the section view is first shown in FIG. 5. The section view shown in FIGS. 8 and 9 are along a similar section plane.

Referring to FIGS. 5 and 7, when the battery assembly 12 is first assembled the tab 16 is inserted between a battery 32 and the terminal 42 of the conductor 18 so that a circuit between the light 24 and battery 32 is interrupted and so that no current can flow into the light 24 and the energy in the battery 32 is preserved for future use.

Typically the device 10 is transported and stored, as shown in FIG. 7, with the tab 16 physically between the battery 32 and the terminal 42 thereby impeding the current from flowing from the battery 32 into the light 24. Prior to using the device 10, the light assembly 20 is affixed to the foot 13 of a vessel 11 and the battery assembly 12 is affixed to the sidewall 15 of the vessel 11.

When a user of the device 10 wants to illuminate the light 24 the tab 16 is removed, as demonstrated in FIG. 5, so that the current in the battery 32 can flow uninterrupted from the battery 32 through the terminal 42, into the conductor 18 and into the light 24 thereby causing the light 24 to illuminate. The circuit is completed by the second conductive element in the conductor 18 that is connected to the terminal 44 and therefore the battery 32.

An alternate style of battery assembly 12 is shown in FIGS. 6, 8 and 9 and further includes an aperture 46 in addition to aperture 30 as well as an alternate tab 34 with integral aperture 36. The principal difference in this variation is that the switching means may be selectively and repeatedly turned on and off.

The device may be stored and transported in a configuration similar to that shown in FIG. 9. It can be seen that the tab 34 is positioned so that it physically comes between the terminal 42 and the battery 32 thereby preventing completion of a circuit thus the device is in an "off" configuration. The tab 34 is preferably made from a thin flexible material that is not electrically conductive.

When the operator of the device desires to turn the device "on" and illuminate the light 24 the tab 34 is pulled and repositioned so that the aperture 36 comes between the terminal 42 and the battery 32 thereby completing the circuit. It should be noticed that the tab 34 is not necessarily removed from the battery assembly 12 in this variation of the device. The tab 34 may then subsequently be pulled and repositioned again so that the aperture 36 is moved away from terminal 42 and the tab 34 interrupts the flow of electricity from the battery 32 to the light assembly 20.

As is now apparent, this variation of the device shown in FIGS. 8 and 9 can be effectively selectively switched on and off repeatedly. Another enhancement not shown in the drawings is a feature at the both ends of the tab 34 that prevents the tab 34 from being pulled through either aperture 46 or aperture 30. This will prevent the tab from being fully removed from the battery assembly 12 and retain the functionality as the switch. In some uses of the device it may be preferred to have the option to remove the tab 34 fully to permanently turn on the device.

A preferred version of the lighting device can be described as comprising a light assembly, a battery assembly and a conductor. Said light assembly comprising an adhesive layer, a substrate and a light source. Said adhesive layer and said light source affixed to said substrate of said light assembly. Said adhesive layer of the light assembly is adapted for attachment to an exterior bottom surface of a foot of a preselected vessel, such as a bottle, cup, vase or other transparent material. The light assembly is dimensioned to fit within the perimeter of the foot of said preselected vessel. Alternately the light assembly may be larger than the foot of the vessel but then preferably has a comparable shape to the foot of the vessel. Said light source of said light assembly adapted to emit light toward said foot of said preselected vessel thereby lighting the vessel. Said light assembly has a substantially uniform thickness between approximately 0.5 millimeters and 5.0 millimeters. Other thicknesses are possible so long as the stability of the vessel is maintained. Said battery assembly comprising a case, a power source, such as multiple batteries, and a switch means. Said battery assembly adapted to contain a power source. Said battery assembly has an adhesive surface adapted for attachment to a sidewall of said preselected vessel. A pressure sensitive adhesive with a removable backing to protect the adhesive during storage and transport is preferred but alternate means to affix the battery to the sidewall of the vessel are commonly known to exist. Said conductor adapted to electrically connect said light source to said power source creating an electrical circuit. Said electrical circuit has a switch means to selectively permit energy from the power source to be conducted to light source. Said conductor is as thick as or less thick than said light assembly.

The lighting device can be further characterized in that said power source is one or a multiplicity of batteries, a fuel cell, or other compact contained power supplies available in the art.

The lighting device could be further characterized in that said conductor is a thin film flexible circuit board, a ribbon wire or other thin electrical conductor. A fiber optic conductor could also be employed if the light source is contained in the battery assembly. The said light source is a light emitting diode or other available compact lamp.

The switch means may be integrated into said battery assembly and comprises a tab that is non-conducting, adapted so that the tab is physically between and interrupts said electrical circuit between said power source and said conductor further adapted so that said tab may be pulled out from between the power source and conductor thereby completing said electrical circuit and permitting the power source to supply power to the light source. This is a generally a one use switch in that there may be no provision to re-insert the tab to stop the flow of electricity from the batteries to the light source.

The lighting device might be optionally further characterized in that said switch means is integrated into said battery assembly and comprises a tab that is non-conducting and adapted so that when selectively placed in a first position the tab is physically between said power source and said conductor thereby interrupting said electrical circuit. Said tab is selectively moveable to a second position where said aperture is between said power source and said conductor thereby permitting completion of said electrical circuit.

Another important variation of the device may be described as a lighting device comprising a light assembly, a battery assembly and a thin film conductor. Said light assembly comprising an adhesive layer, a substrate and a lamp. Said adhesive layer and said lamp are affixed to said substrate of said light assembly. Said adhesive layer of said light assembly is adapted for attachment to an exterior bottom surface of a foot of a preselected vessel. Said light is assembly dimensioned to fit within the perimeter of the foot of said preselected vessel or slightly larger than the perimeter. Said lamp adapted to emit light toward and into said foot of said vessel. The vessel is not always part of the claimed invention but is included to show a primary use of the device. Said light assembly has a substantially uniform thickness between approximately 0.5 millimeters and 5.0 millimeters. Other appropriate thicknesses may be determined by trial and error based on the specific preselected vessel that a variation of the device is designed to work best with. Said battery assembly comprising a case, between one and four batteries and a switch means. Said battery assembly has an adhesive surface adapted for attachment to a sidewall of said preselected vessel. Said thin film conductor adapted to electrically connect said lamp to said batteries creating an electrical circuit. Said electrical circuit has a switch means to selectively permit energy from said batteries to be conducted to the lamp. Said thin film conductor is about as thick as or less thick than said light assembly to impart stability of the vessel when used with the invention.

This variation of the invention can be further characterized in that said switch means comprises a non-conducting tab that physically interrupts contact points between any two of said batteries or any one of said batteries and said conductor thereby preventing completion of said electrical circuit. Said tab is selectively removable from between said contact points thereby permitting completion of said electrical circuit.

It might be further characterized in that said switch means is integrated into said battery assembly and comprises a tab that is non-conducting and adapted so that when selectively placed in a first position the tab is physically between said power source and said conductor thereby interrupting said electrical circuit. Said tab is selectively moveable to a second position where said aperture is between said power source and said conductor thereby permitting completion of said electrical circuit.

In any of the variations of the device testing has shown that the light assembly is typically most effective when about one to three inches in diameter and about one to two millimeters thick. Effective conductor lengths are about one to four inches. These ranges are provided for guidance and understanding and may materially deviate from these dimensions and yet remain effective.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A lighting device comprising a light assembly, a battery assembly and a conductor;

said light assembly comprising an adhesive layer, a substrate and a light source;

said adhesive layer and said light source affixed to said substrate of said light assembly;

said adhesive layer of said light assembly is a pressure sensitive adhesive and is adapted for attachment to an exterior bottom surface of a foot of a vessel;

said light assembly dimensioned to fit within the perimeter of the foot of said vessel;

said light source of said light assembly adapted to emit light toward said foot of said vessel;

said light assembly has a substantially uniform thickness between approximately 0.5 millimeters and 5.0 millimeters;

said battery assembly comprising a case, a power source and a switch means;

said battery assembly adapted to contain a power source;

said battery assembly has a pressure sensitive adhesive surface adapted for attachment to a sidewall of said vessel;

said conductor adapted to electrically connect said light source to said power source, traversing a bottom exterior edge of the vessel, creating an electrical circuit without significantly affecting the stability of the vessel;

said electrical circuit has a switch means to selectively permit energy from the power source to be conducted to light source;

said conductor is as thick as or less thick than said light assembly.

2. A lighting device as disclosed in claim 1 further characterized in that said power source is one or a multiplicity of batteries.

3. A lighting device as disclosed in claim 1 further characterized in that said conductor is a thin film conductor.

4. A lighting device as disclosed in claim 1 further characterized in that said light source is a light emitting diode.

5. A lighting device as disclosed in claim 1 further characterized in that said switch means is integrated into said battery assembly and comprises a tab that is non-conducting, adapted so that the tab is physically between and interrupts said electrical circuit between said power source and said conductor further adapted so that said tab may be pulled out from between the power source and conductor thereby completing said electrical circuit and permitting the power source to supply power to the light source.

6. A lighting device as disclosed in claim 1 further characterized in that said switch means is integrated into said battery assembly and comprises a tab that is non-conducting and adapted so that when selectively placed in a first position the tab is physically between said power source and said conductor thereby interrupting said electrical circuit;

said tab is selectively moveable to a second position where said aperture is between said power source and said conductor thereby permitting completion of said electrical circuit.

7. A lighting device comprising a light assembly, a battery assembly and a thin film conductor;

said light assembly comprising a pressure sensitive adhesive layer, a substrate and a lamp;

said pressure sensitive adhesive layer and said lamp affixed to said substrate of said light assembly;

said pressure sensitive adhesive layer of said light assembly is adapted for attachment to an exterior bottom surface of a foot of a vessel;

said light assembly dimensioned to fit within the perimeter of the foot of said vessel;

said lamp adapted to emit light toward said foot of said vessel;

said light assembly has a substantially uniform thickness between approximately 0.5 millimeters and 5.0 millimeters;

said battery assembly comprising a case, between one and four batteries and a switch means;

said battery assembly has a pressure sensitive adhesive surface adapted for attachment to an exterior sidewall of said vessel;

said thin film conductor adapted to electrically connect said lamp to said batteries, traversing a bottom exterior edge of the vessel, creating an electrical circuit;

said electrical circuit has a switch means to selectively permit energy from said batteries to be conducted to the lamp;

said thin film conductor is as thick as or less thick than said light assembly.

8. A lighting device as disclosed in claim 7 further characterized in that said switch means comprises a non-conducting tab that physically interrupts contact points between any two of said batteries or any one of said batteries and said conductor thereby preventing completion of said electrical circuit;

said tab is selectively removable from between said contact points thereby permitting completion of said electrical circuit.

9. A lighting device as disclosed in claim 7 further characterized in that said switch means is integrated into said battery assembly and comprises a tab that is non-conducting and adapted so that when selectively placed in a first position the tab is physically between said power source and said conductor thereby interrupting said electrical circuit;

said tab is selectively moveable to a second position where said aperture is between said power source and said conductor thereby permitting completion of said electrical circuit.

* * * * *